US012564268B2

(12) United States Patent
Grossman et al.

(10) Patent No.: US 12,564,268 B2
(45) Date of Patent: Mar. 3, 2026

(54) FURNITURE OBJECTS INCLUDING A CONVERTIBLE DESK BED

(71) Applicant: Night and Day Furniture LLC, Vancouver, WA (US)

(72) Inventors: Joel Grossman, Petaling Jaya (MY); Howard Porter, Kuala Lumpur (MY)

(73) Assignee: Night and Day Furniture LLC

( * ) Notice: Subject to any disclaimer, the term of this patent is extended or adjusted under 35 U.S.C. 154(b) by 125 days.

(21) Appl. No.: 18/359,244

(22) Filed: Jul. 26, 2023

(65) Prior Publication Data

US 2025/0031860 A1 Jan. 30, 2025

(51) Int. Cl.
*A47C 17/62* (2006.01)
*A47C 17/54* (2006.01)

(52) U.S. Cl.
CPC ..... *A47C 17/62* (2013.01); *A47C 17/54* (2013.01)

(58) Field of Classification Search
CPC ..... A47C 17/62; A47C 17/52; A47C 17/54; A47C 17/60
See application file for complete search history.

(56) References Cited

U.S. PATENT DOCUMENTS

| | | | |
|---|---|---|---|
| 3,792 | A | 10/1844 | Kingman |
| 83,936 | A | 11/1868 | Crosby |
| 93,556 | A | 8/1869 | Robinson |
| 157,719 | A | 12/1874 | Iverson |
| 179,013 | A | 6/1876 | Green |
| 189,303 | A | 4/1877 | Crosby |
| 192,621 | A | 7/1877 | Green |
| 201,282 | A | 3/1878 | Ogborn |
| RE8,270 | E | 6/1878 | Maine |
| 215,134 | A | 5/1879 | Kiss |
| 218,678 | A | 8/1879 | Koskul |
| 225,393 | A | 3/1880 | Kendrick |
| 239,805 | A | 4/1881 | Knapp |
| 268,307 | A | 11/1882 | Stanton |
| 319,083 | A | 6/1885 | Farrar |
| 327,076 | A | 9/1885 | Farrar |
| 348,643 | A | 9/1886 | Strahan |
| 354,729 | A | 12/1886 | Montgomery, Jr. |
| 379,449 | A | 3/1888 | Condell |

(Continued)

FOREIGN PATENT DOCUMENTS

| | | | |
|---|---|---|---|
| CA | 2857823 | A1 | 1/2016 |
| CN | 2757674 | Y | 2/2006 |

(Continued)

OTHER PUBLICATIONS

Notice of Allowance issued Jun. 18, 2025 in U.S. Appl. No. 17/747,336.

*Primary Examiner* — Daniel J Rohrhoff
(74) *Attorney, Agent, or Firm* — Harness, Dickey & Pierce, P.L.C.

(57) ABSTRACT

A convertible furniture apparatus includes a frame; a convertible assembly connected to the frame via at least a pair of pivot points each connected to respective side panels of the frame, the convertible assembly configured to transition between a first position and a second position by pivoting about the pivot points; and a binding assembly configured to selectively cinch the convertible assembly to the frame, when the convertible assembly is in the first position or the second position.

19 Claims, 13 Drawing Sheets

(56) References Cited

U.S. PATENT DOCUMENTS

| | | | | |
|---|---|---|---|---|
| 394,688 | A | 12/1888 | Green | |
| 431,825 | A | 7/1890 | Sundback | |
| 445,777 | A | 2/1891 | Goodwillie | |
| 474,587 | A | 5/1892 | Yeager | |
| 538,470 | A | 4/1895 | Lungstras | |
| 565,496 | A | 8/1896 | Robinson | |
| 716,026 | A | 12/1902 | Geisel | |
| 791,857 | A | 6/1905 | Arnold | |
| 981,402 | A | 1/1911 | Schenbruecher | |
| 1,023,562 | A | 4/1912 | Haberman | |
| 1,170,149 | A | 2/1916 | Gustafson | |
| 1,359,337 | A | 11/1920 | Culbertson | |
| 1,366,368 | A | 1/1921 | Draper | |
| 1,375,524 | A | 4/1921 | McGhee | |
| 1,567,258 | A | 12/1925 | Galik | |
| 1,639,163 | A | 8/1927 | Burger | |
| 1,757,068 | A | 5/1930 | Wikman | |
| 1,987,592 | A | 1/1935 | Bodmer | |
| D110,907 | S | 8/1938 | Patz | |
| 2,356,321 | A | 8/1944 | Irick | |
| D158,038 | S | 4/1950 | Barmache | |
| 2,544,762 | A | 3/1951 | Lochridge | |
| 2,566,256 | A | 8/1951 | Snyder | |
| 2,577,741 | A | 12/1951 | Creveling | |
| D165,746 | S | 1/1952 | Gaines | |
| 2,641,000 | A | 6/1953 | Enewold | |
| 2,788,528 | A | 4/1957 | Hansen | |
| 2,856,612 | A | 10/1958 | Wheeler | |
| 3,097,369 | A | 7/1963 | Emch | |
| 3,537,769 | A | 11/1970 | Di Carlo | |
| 3,540,788 | A | 11/1970 | Lundquist | |
| 3,581,318 | A | 6/1971 | Kroupa | |
| 3,638,249 | A | 2/1972 | Katsigarakis | |
| 3,703,735 | A | 11/1972 | Moore | |
| 3,755,832 | A | 9/1973 | Bennett | |
| D228,990 | S | 11/1973 | Villanova | |
| 3,858,253 | A | 1/1975 | Lauzon | |
| 3,863,281 | A | 2/1975 | Tosic | |
| 3,965,498 | A | 6/1976 | Boni | |
| 4,070,715 | A * | 1/1978 | Reppas | A47C 17/52 5/2.1 |
| 4,263,854 | A | 4/1981 | Moore et al. | |
| 4,277,856 | A | 7/1981 | Danin | |
| 4,300,761 | A | 11/1981 | Howard | |
| 4,318,195 | A * | 3/1982 | Reppas | A47C 17/62 5/2.1 |
| D276,386 | S | 11/1984 | Shaw | |
| D279,339 | S | 6/1985 | Testa | |
| 4,793,011 | A | 12/1988 | Eve | |
| 4,999,865 | A | 3/1991 | Sauder et al. | |
| 5,101,523 | A | 4/1992 | Bright | |
| 5,353,452 | A | 10/1994 | Rulis | |
| 5,400,447 | A | 3/1995 | Pokorny | |
| 5,440,768 | A | 8/1995 | Danin | |
| 5,522,102 | A | 6/1996 | Vayda | |
| 5,652,978 | A | 8/1997 | Wiig | |
| 5,794,283 | A | 8/1998 | Vila et al. | |
| 5,806,248 | A | 9/1998 | Kim | |
| 5,913,769 | A | 6/1999 | Byma et al. | |
| 6,088,849 | A | 7/2000 | Lieber | |
| 6,401,276 | B1 | 6/2002 | Sherman | |
| 6,463,603 | B1 | 10/2002 | Camfield | |
| 6,851,139 | B2 | 2/2005 | Arason et al. | |
| 7,013,506 | B2 | 3/2006 | Revels | |
| 7,017,201 | B2 * | 3/2006 | Lin | A47C 17/62 5/2.1 |
| 7,140,052 | B2 * | 11/2006 | Monestier | A47C 17/62 5/2.1 |
| 7,231,675 | B1 | 6/2007 | Rucinski et al. | |
| D583,586 | S | 12/2008 | Gudenkauf | |
| 7,574,758 | B2 | 8/2009 | Arason et al. | |
| 8,006,327 | B1 | 8/2011 | Burchett | |
| D663,141 | S | 7/2012 | Ardis et al. | |
| D669,706 | S | 10/2012 | Zambelli | |
| 8,407,830 | B1 | 4/2013 | Kumar | |
| 8,572,776 | B2 | 11/2013 | Grubb | |
| D712,676 | S | 9/2014 | Flora | |
| D714,087 | S | 9/2014 | Youngstrom | |
| 8,833,518 | B2 | 9/2014 | Holcombe | |
| 8,943,624 | B1 | 2/2015 | Youngstrom | |
| D742,136 | S | 11/2015 | Flora | |
| 9,289,063 | B2 | 3/2016 | Baugh et al. | |
| 9,370,244 | B1 | 6/2016 | Kumar | |
| 9,468,305 | B2 | 10/2016 | Flora | |
| 9,549,618 | B1 | 1/2017 | Honarvar | |
| D793,127 | S | 8/2017 | Zhuravlev | |
| 9,744,400 | B2 | 8/2017 | Cole | |
| D814,830 | S | 4/2018 | Flora | |
| D817,666 | S | 5/2018 | Davis et al. | |
| 10,349,750 | B2 | 7/2019 | Porter | |
| D884,395 | S | 5/2020 | Flora | |
| D910,341 | S | 2/2021 | Ye | |
| D963,381 | S | 9/2022 | Davis et al. | |
| D1,006,476 | S | 12/2023 | Byrne | |
| D1,014,144 | S | 2/2024 | Zheng | |
| D1,022,538 | S | 4/2024 | Bergmann et al. | |
| D1,024,625 | S | 4/2024 | Song | |
| D1,047,492 | S | 10/2024 | Ju | |
| D1,058,248 | S | 1/2025 | Mao | |
| D1,059,087 | S | 1/2025 | Yang | |
| 2001/0049843 | A1 | 12/2001 | Barnett | |
| 2004/0093669 | A1 | 5/2004 | Arason et al. | |
| 2006/0031986 | A1 | 2/2006 | Revels | |
| 2006/0225210 | A1 | 10/2006 | Arason et al. | |
| 2006/0230530 | A1 | 10/2006 | Avishay | |
| 2008/0016617 | A1 * | 1/2008 | Plantefever | A47C 17/62 5/3 |
| 2008/0229497 | A1 | 9/2008 | Paoutoff | |
| 2008/0264723 | A1 | 10/2008 | Tatum | |
| 2010/0043142 | A1 | 2/2010 | Whitford | |
| 2011/0304251 | A1 | 12/2011 | Bernett et al. | |
| 2012/0073045 | A1 | 3/2012 | Grubb | |
| 2014/0047638 | A1 | 2/2014 | Zimmer | |
| 2016/0022048 | A1 | 1/2016 | Flora | |
| 2016/0037934 | A1 | 2/2016 | Porter | |
| 2016/0058196 | A1 | 3/2016 | Grubb | |
| 2016/0242556 | A1 * | 8/2016 | Ray | A47B 85/06 |
| 2019/0167008 | A1 | 6/2019 | Grossman et al. | |
| 2019/0191889 | A1 | 6/2019 | Flora | |
| 2019/0343292 | A1 | 11/2019 | Porter et al. | |
| 2021/0037983 | A1 * | 2/2021 | Marjadsingh | A47C 17/38 |
| 2024/0008648 | A1 | 1/2024 | Sullivan et al. | |
| 2025/0031860 | A1 | 1/2025 | Grossman et al. | |

FOREIGN PATENT DOCUMENTS

| | | | |
|---|---|---|---|
| CN | 201557794 | U | 8/2010 |
| CN | 304148658 | | 8/2016 |
| CN | 307374430 | | 3/2022 |
| FR | 536132 | A | 4/1922 |
| FR | 953688 | A | 12/1949 |
| FR | 1084476 | A | 1/1955 |
| FR | 1589047 | A | 3/1970 |
| KR | 101601937 | B1 * | 3/2016 |
| TH | 2002005695 | | 12/2020 |

* cited by examiner

FURNITURE OBJECTS INCLUDING A CONVERTIBLE DESK BED

FIELD

The present disclosure relates generally to furniture objects configured to convert between at least a desk and a bed.

BACKGROUND

The statements in this section merely provide background information related to the present disclosure and may not constitute prior art.

Often, furniture apparatuses capable of more than one function are used in environments (e.g., residential, commercial, etc.) where space is limited. For example, futon beds or other like foldable beds may be used in such environments as sitting furniture (e.g., couches, sofas, etc.) and lying and/or sleeping furniture (e.g., beds, etc.). In these environments, futon beds may make more efficient use of the limited space and may relieve the need for additional furniture. However, even futon beds may take up too much space in certain environments that also include, for example, a desk or other working surface.

SUMMARY

Some example embodiments relate to a convertible furniture apparatus.

In some example embodiments, the convertible furniture apparatus includes a frame; a convertible assembly connected to the frame via at least a pair of pivot points each connected to respective side panels of the frame, the convertible assembly configured to transition between a first position and a second position by pivoting about the pivot points; and a binding assembly configured to selectively cinch the convertible assembly to the frame, when the convertible assembly is in the first position or the second position.

In some example embodiments, the convertible furniture apparatus includes a pair of assemblies; and connecting legs pivotally connecting the pair of assemblies.

In some example embodiments, the pair of assemblies include a first assembly including a pair of first side rails, a first long rail extending perpendicular to the pair of first side rails and a first base attached to the pair of first side rails and the first long rail; and a second assembly including a pair of second side rails, a pair of second long rails extending perpendicular to the pair of second side rails and a second base attached to the pair of second side rails and the pair of second long rails, wherein the connecting legs are fixedly attached to a bottom surface of respective ones of the pair of second side rails and rotatably attached to a top surface of respective ones of the pair of first side rails.

In some example embodiments, the first assembly is a desk assembly and the second assembly is a bed assembly with an upper surface of the first base configured as a desktop of the desk assembly and a lower surface of the first base configured as a backboard of the desk assembly when the convertible furniture apparatus is in the first position, and an upper surface of the second base configured as a bed platform of the bed assembly when the convertible furniture apparatus is in the second position.

In some example embodiments, during the transition between the first position and the second position, the desktop remains level while the bed platform pivots 90 degrees.

In some example embodiments, the bed platform is perpendicular to the desktop when the convertible furniture apparatus is in the first position such that the bed platform is stowed vertically, and the bed platform is to parallel to the desktop when the convertible furniture apparatus is in the second position.

In some example embodiments, the convertible furniture apparatus further includes a mechanical assembly including a plate secured to a respective one of the side panels, the plate having a pivot bushing extending therefrom defining a respective one of the pivot points, a hook arm having a first end rotatably connected to the plate and a second end rotatably connected a respective one of the pair of first side rails, and a gas lift configured to transmit a force to the hook arm to counterbalance a weight of the convertible assembly.

In some example embodiments, connections between the frame and the convertible assembly form a parallelogram with a shape that adjusts to allow the desktop to remain level during the transition between the first position and the second position.

In some example embodiments, an amount of the force transmitted by the gas lift is adjustable based on the weight of the convertible assembly.

In some example embodiments, when the binding assembly cinches the convertible assembly to each of the side panels of the frame, the convertible assembly is connected to each of the side panels of the frame at respective ones of the pivot points at which the convertible assembly is free to move relative to the frame and at cinch points at which the convertible assembly is restricted from moving relative to the frame.

In some example embodiments, the cinch points are further from a back panel of the frame than respective ones of the pivot points.

In some example embodiments, at the cinch points, a gap between the convertible assembly and the side panels of the frame decreases when the binding assembly cinches the convertible assembly to the side panels of the frame.

In some example embodiments, the binding assembly is configured to traverse first through holes in the pair of first side rails to cinch the first assembly to the frame when the convertible furniture apparatus is in the first position, and to traverse second through holes in the pair of second side rails to cinch the second assembly to the frame when the convertible furniture apparatus is in the second position.

In some example embodiments, the binding assembly includes a first portion and a second portion, the first portion configured to selectively mate with the second portion by traversing at least the first through holes or the second through holes depending on a position of the convertible furniture apparatus.

In some example embodiments, the second portion is fixedly attached to respective ones of the side panels of the frame.

In some example embodiments, the second portion includes two sockets attached fixedly attached at different heights to each of the side panels of the frame.

In some example embodiments, the two sockets include a first socket configured to selectively mate with the second portion to cinch the first assembly to the frame when the convertible furniture apparatus is in the first position, the first socket being fixedly attached a first height to each of the side panels of the frame; and a second socket configured to selectively mate with the second portion to cinch the second assembly to the frame when the convertible furniture apparatus is in the second position, the second socket being fixedly attached a second height to each of the side panels of the frame, the second height being less than the first height.

In some example embodiments, the side panels of the frame include fixed through holes therein extending from a first side the side panels that face the convertible assembly to a second side opposite the first side, and the first portion of the binding assembly is configured to selectively mate with the second portion of the binding assembly by, after traversing the at least the first through holes or the second through holes, further traversing through the fixed through holes in the side panels of the frame from the first side of the side panels to mate with the second portion of the binding assembly from the second side of the side panels.

Further areas of applicability will become apparent from the description and figures provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
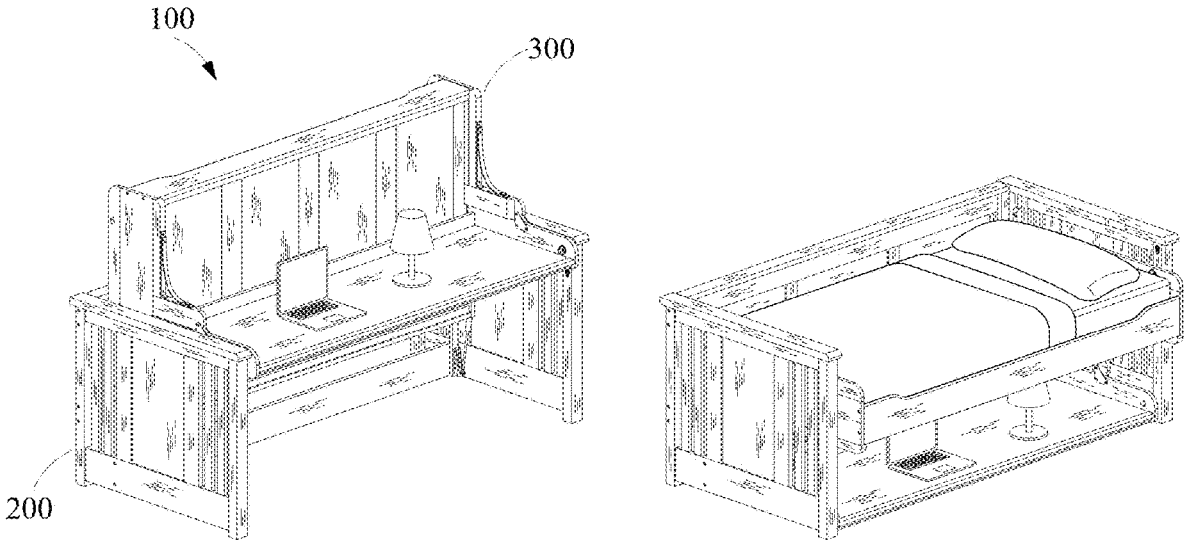
FIG. 1 illustrates a convertible furniture object in a first position and a second position according to some example embodiments.

The following description is merely exemplary in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the concept of the invention to those skilled in the art.

Example embodiments relate to a furniture object configured to store a foldable bed. Example embodiments provide that the furniture object may be a chest, cabinet, coffer, trunk, or any other like furniture object configured and/or adaptable to store a foldable bed. The furniture object described herein may be constructed, manufactured, or otherwise built in a variety of shapes including any rectangular shape, square shape, and/or any other like shape. The furniture objects described herein may be constructed, manufactured, or otherwise built using a variety of materials, such as wood, plastic, metal, minerals and/or any combination thereof.

Figure 2:
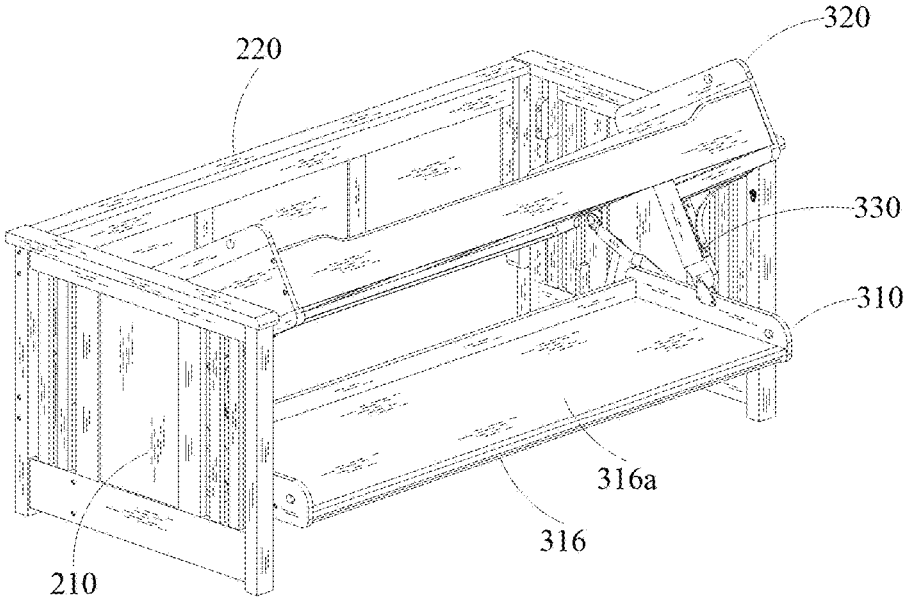
FIG. 2 illustrates a convertible furniture object in transition between the first position and the second position according to some example embodiments.
Figure 3:
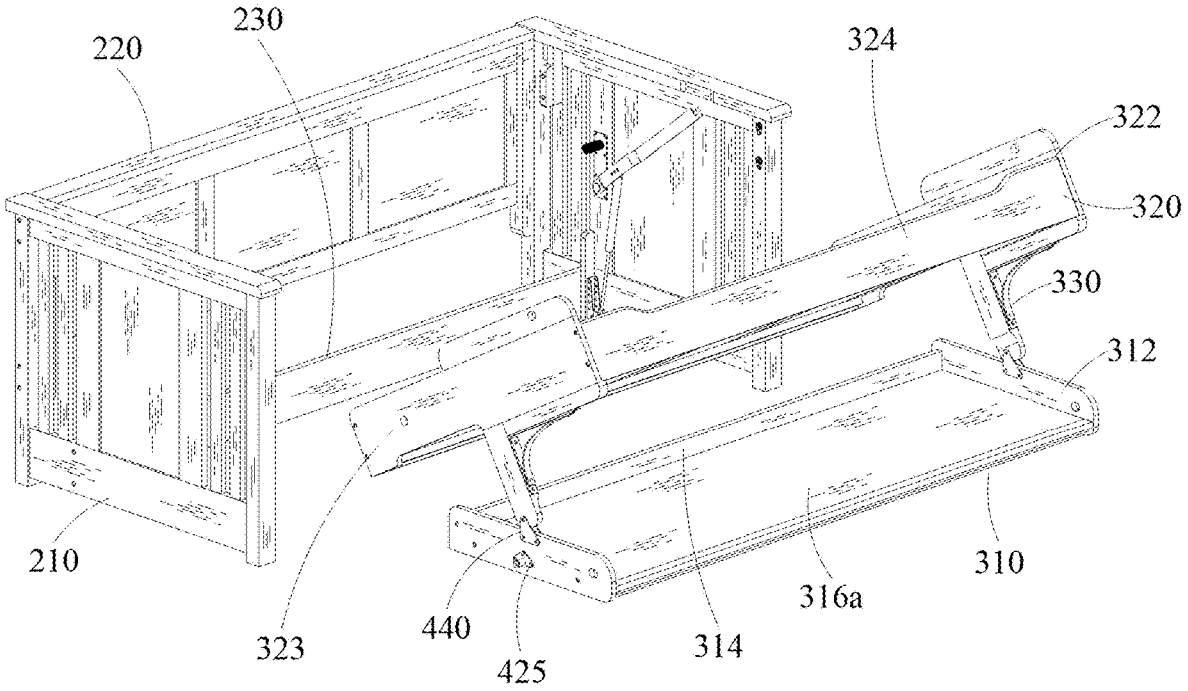
FIG. 3 illustrates a front right exploded view of a convertible furniture object according to some example embodiments.
Figure 4:
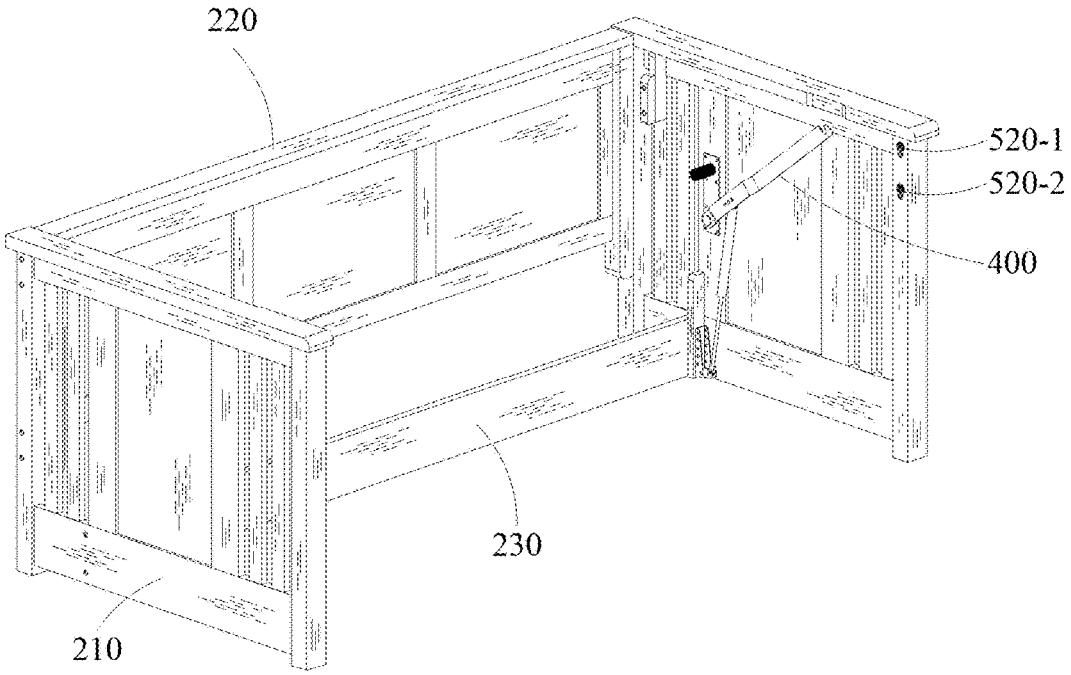
FIG. 4 illustrates a frame of a convertible furniture object with a mechanical assembly attached thereto according to some example embodiments.
Figure 5:
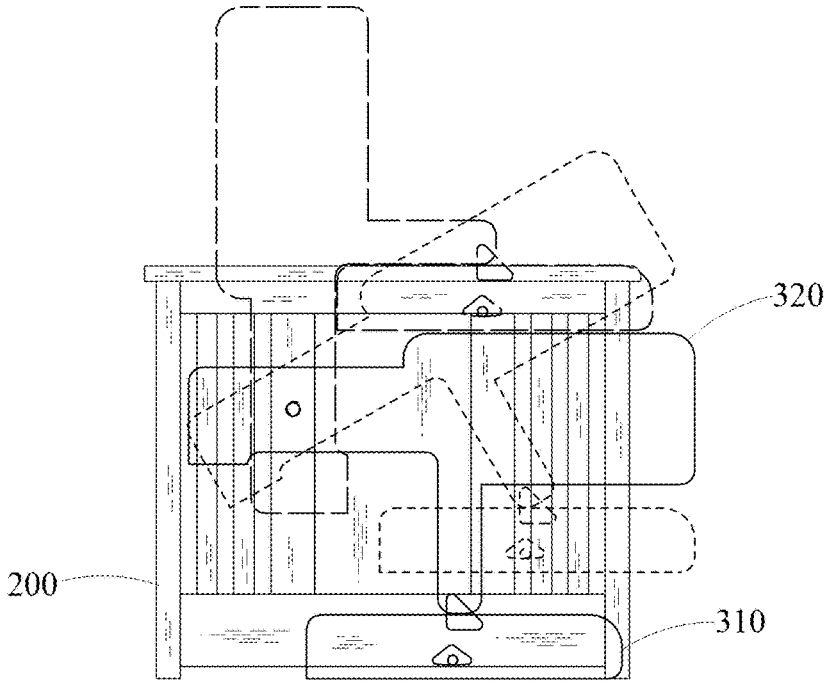
FIGS. 5 to 7 illustrates various perspectives of a convertible furniture object in the first position, the second position and the transition therebetween according to some example embodiments.
Figure 6:
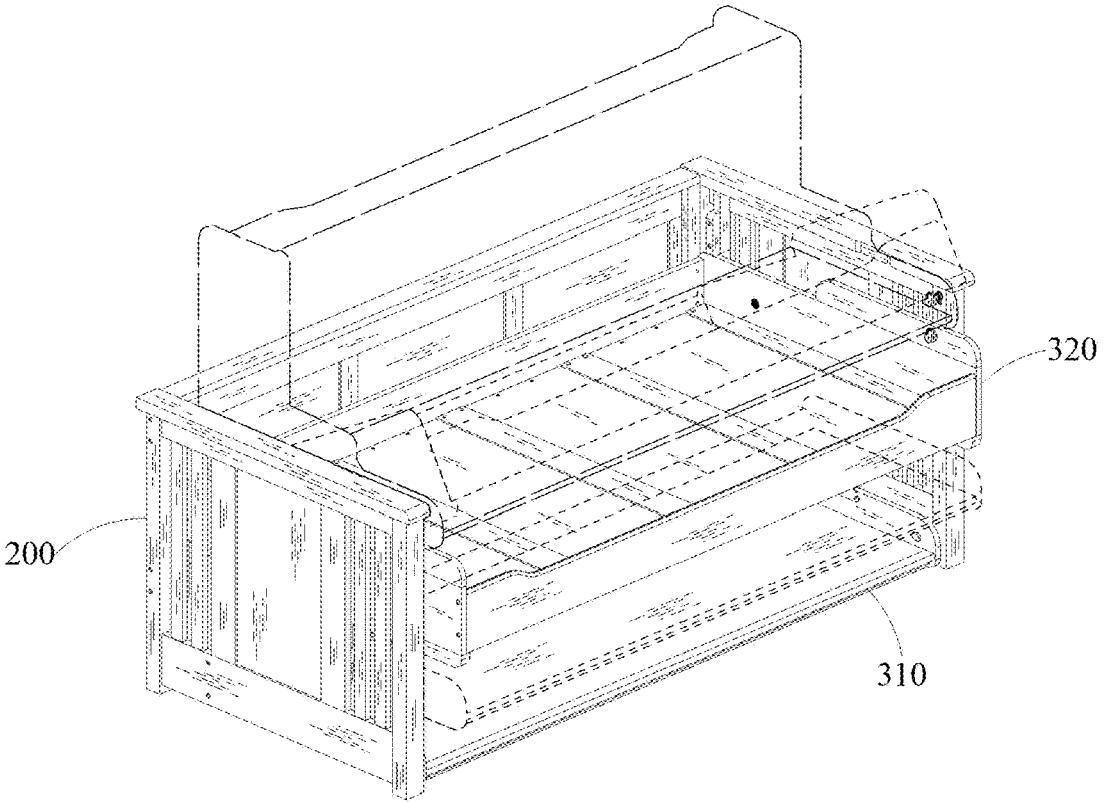
Figure 7:
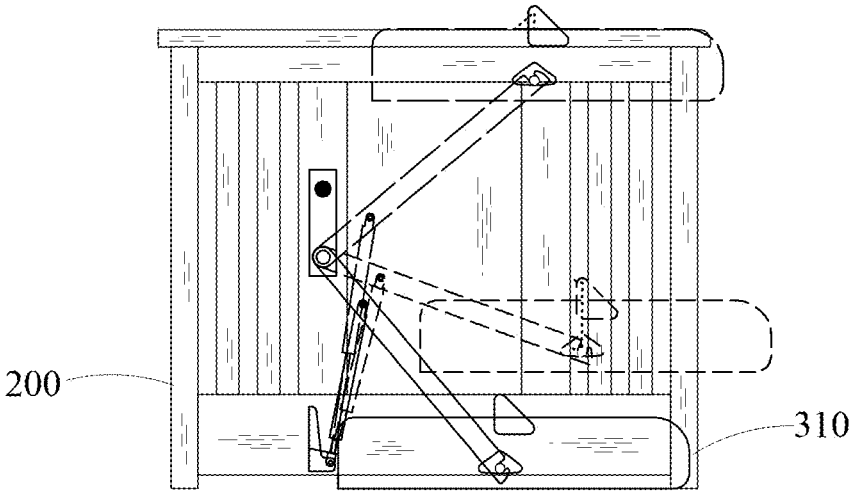

FIG. 1 illustrates a convertible furniture object in a first position and a second position according to some example embodiments, FIG. 2 illustrates a convertible furniture object in transition between the first position and the second position according to some example embodiments, FIG. 3 illustrates a front right exploded view of a convertible furniture object according to some example embodiments, FIG. 4 illustrates a frame of a convertible furniture object with a mechanical assembly attached thereto according to some example embodiments, and FIGS. 5 to 7 illustrates various perspectives of a convertible furniture object in the first position, the second position and the transition therebetween according to some example embodiments.

Referring to FIGS. 1-7, a convertible furniture object 100 includes a frame 200 and a convertible assembly 300.

The convertible furniture object 100 is configured to convert between a first position (or, alternatively, a desk position), shown in the left side of FIG. 1, and a second position (or, alternatively, a bed position), shown in the right side of FIG. 1, by manipulating the convertible assembly 300. The convertible furniture object 100 is configured to operate as a desk when in the first position and to operate as bed when in the second position.

The frame 200 may include side panels 210 and a back panel 220. The side panels 210 may be provided in plural such that one of the side panels 210 is provided on each side of the frame 200. In some example embodiments, the side panels 210 may be hingably connected to the back panel 220 within a factory and shipped as a kit in compacted form while simplifying setup of the convertible furniture object 100 by a user. However, example embodiments are not limited thereto, and instead the side panels 210 may be fixedly secured to the back panel 220 via fasteners. The frame 200 may further include a stretcher rail 230 that stretches between a lower portion of the side panels 210. In an embodiment in which the side panels 210 are hingably connected to the back panel 220, the stretcher rail 230 may be detachably connected to the side panels 210. However, in example embodiments are not limited thereto and the stretcher rail 230 may be fixedly secured to the side panels 210 via fasteners.

The side panels 210 may have a mechanical assembly 400 attached thereto. For example, a main plate 410 that includes a pivot bushing 415 may be attached to each of the side panels 210 such that the pivot bushings 415 extend in a longitudinal direction toward each other from a rear portion of the side panels 210.

The convertible assembly 300 include a first assembly 310, a second assembly 320 and a pair of connecting legs 330. The first assembly 310 may be a desk assembly and the second assembly 320 may be a bed assembly.

The desk assembly 310 may include a pair of side rails 312, a long rail 314 and a base 316. The base 316 may have an upper surface 316*a* that functions as a desktop.

The bed assembly 320 may include a pair of side rails 322, a pair of long rails 324 and a base 326. The base 326 may have an upper surface 326*a* that functions as a bed platform and a second surface 326*b* that functions a backboard for the desk position. The pair of side rails 322 of the bed assembly 320 may each include a pivot hole 323 therein positioned towards a rear portion thereof, and the pivot hole 323 may be configured to align with the pivot bushing 415 protruding from the main plate 410 of the mechanical assembly 400, which is attached to the side panels 210.

Figure 15:
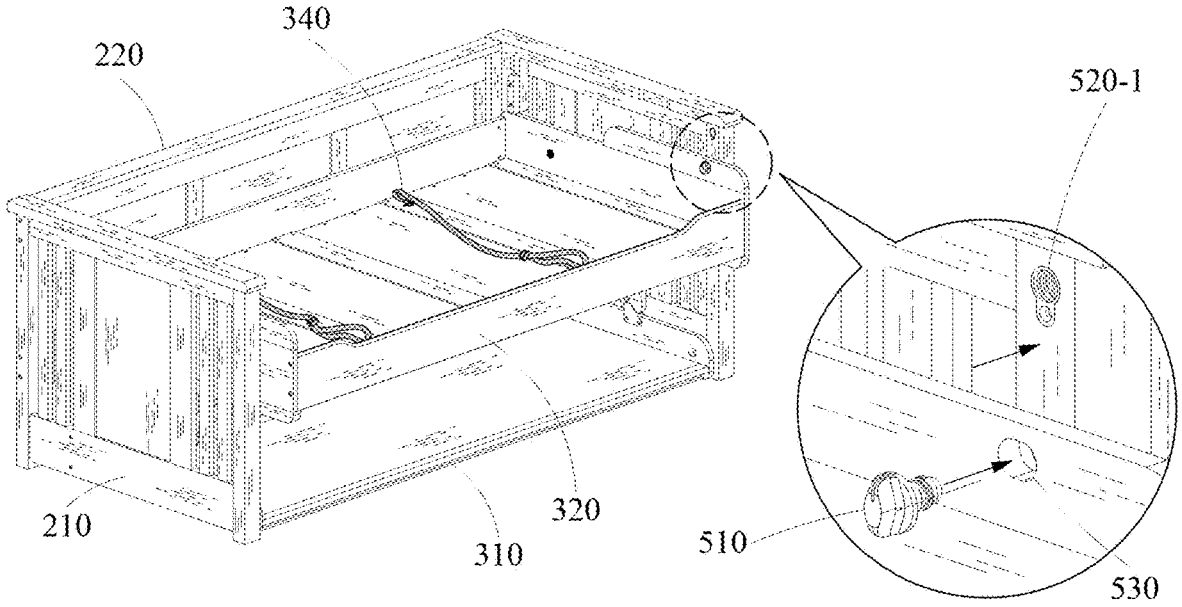

When in the first position (or, alternatively, the desk position), the bed platform 326*a* with a mattress fitted thereon may lie flat against the back of the frame 200 with the mattress and bedding concealed from view by the backboard 326*b*. The bedding may maintain its position due to, for example, lateral compression of the mattress between the back panel 220 and the bed platform 326*a* when the convertible furniture object 100 is in the first position (or, alternatively, the desk position). Further, as illustrated in FIG. 15, a strap 340 may be attached to the bed platform 326*a* to further secure the bedding to the bed platform 326*a*.

The pair of connecting legs 330 may connect the desk assembly 310 and the bed assembly 320. For example, the pair of connecting legs 330 may have a first end rotatably attached to an upper edge of respective ones of the pair of side rails 312 of the desk assembly 310 and a second end fixedly attached a lower edge of respective ones of the pair of side rails 322 of the bed assembly 320.

As discussed in more detail below, the pair of connecting legs 330 and mechanical assembly 400 may allow the desktop 316*a* of the desk assembly 310 to maintain a same level position as the convertible furniture object 100 transitions between the first position and the second position and may maintain a set distance between the desk assembly 310 and the bed assembly 320 (e.g., between the upper surface 316*a* of the desk assembly 310 and the second surface 326*b* of the bed assembly 320) when the convertible furniture object 100 is in the second position (or, alternatively, the bed position). Therefore, the risk of items kept on the desktop 316*a* toppling over or being crushed may be reduced (or, alternatively, eliminated) when the convertible furniture object 100 transitions from the first position (or, alternatively, the desk position) to the second position (or, alternatively, the bed position). Thus, user convenience may increase as the items do not need to be removed from the desktop 316*a* when converting the convertible furniture object 100 from the first position (or, alternatively, the desk position) to the second position (or, alternatively, the bed position).

Figure 8:
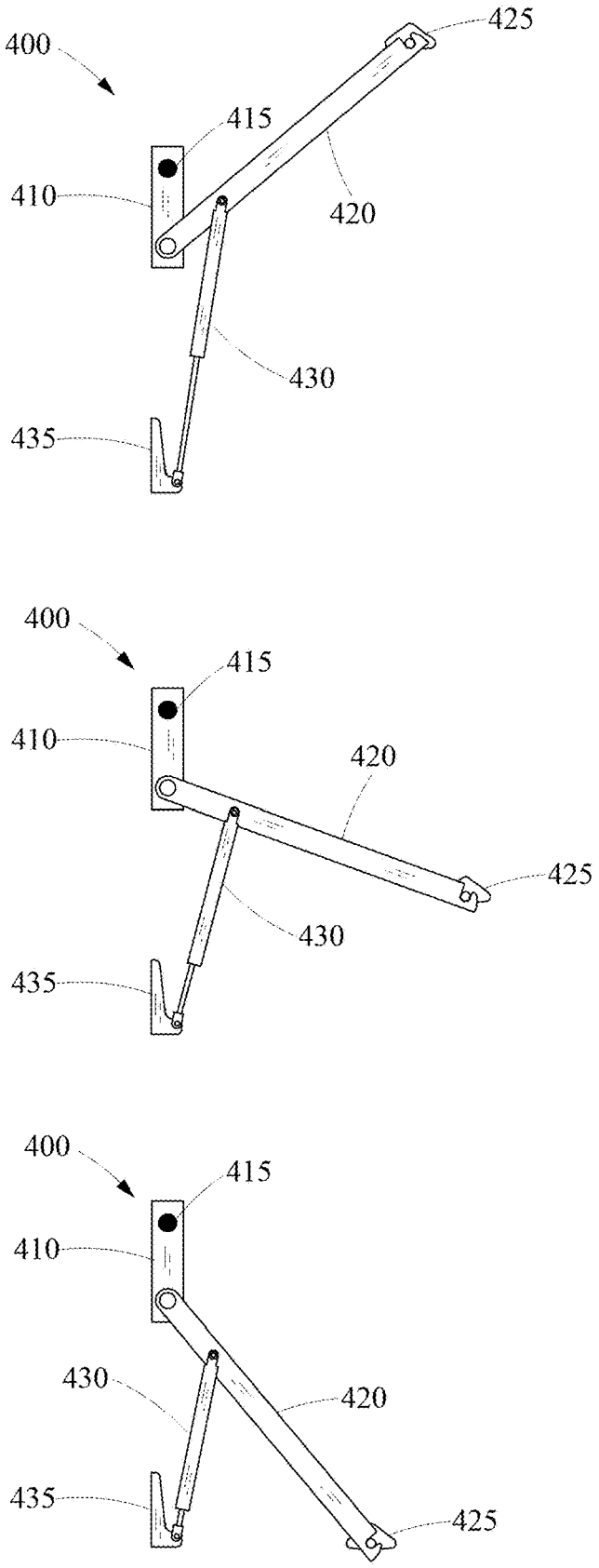
FIGS. 8 to 10 illustrate a mechanical assembly included in the convertible furniture object according to some example embodiments.
Figure 9:
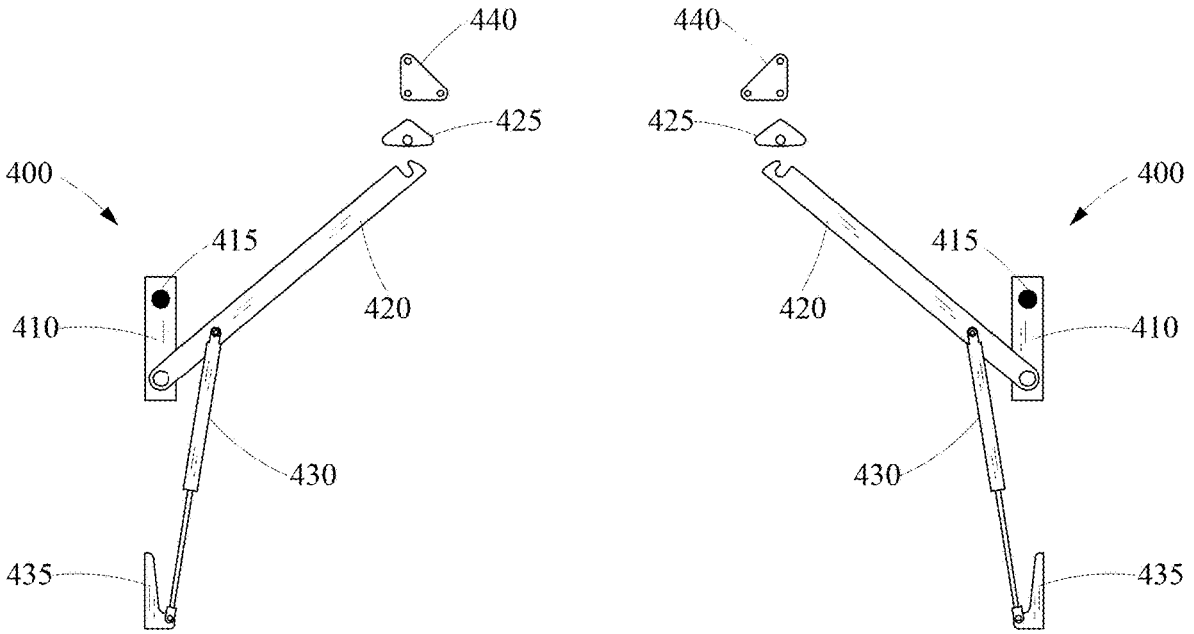
Figure 10:
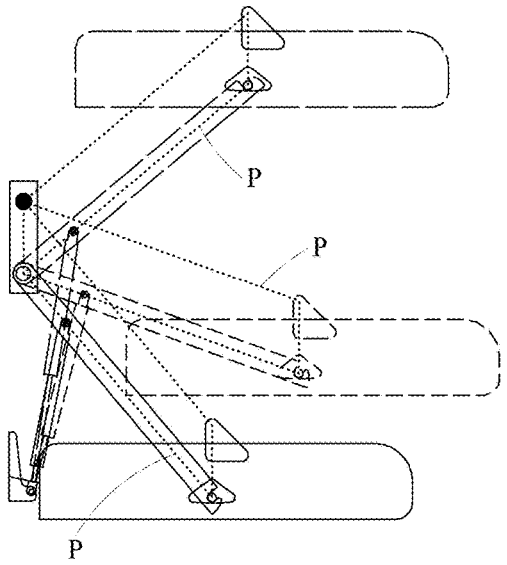

FIGS. 8 to 10 illustrate a mechanical assembly included in the convertible furniture object according to some example embodiments.

Referring to FIGS. 8 and 9, the mechanical assembly 400 may be provided in plural, each including the main plate 410 having the pivot bushing 415 extending in a first direction therefrom and a hook arm 420 extending in a second direction therefrom perpendicular to the first direction. The hook arm 420 may include a hook on an end thereof, where a bearing post 425 attached to the side rails 312 of the desk assembly 310 is configured to sit within the hook. For example, the bearing post 425 may be attached to the center of each of the side rails 312 of the desk assembly 310 and the bearing post 425 may bear a portion of the weight of the convertible assembly 300 when the bearing post 425 sits in the hook of the hook arm 420. The hook arm 420 may have a first end of a balancing system 430 connected thereto, and a second end of the balancing system 420 may be attached to a lower support 435 of the mechanical assembly 400. The lower support 435 may be fastened to the frame 200, for example, to the side panels 210 of the frame 200. The balancing system 430 may be a gas lift such as a gas spring or gas strut or another type of spring or counterweight. In some example embodiments, the balancing system 430 may be adjustable such that the balancing system 430 can provide different levels of assistance force to counteract the gravitational force acting on the convertible assembly 300 as the convertible assembly freely pivots on the pivot bushing 415.

Therefore, a user may adjust the spring force provided by the balancing system 430 based on, for example, the weight of the items stored on the desktop 316*a* and/or the weight of the mattress and bedding on the bed platform 326*a*.

The mechanical assembly 400 may further include a pair of joining pivot plates 440 that are configured to connect respective ones of the pair of connecting legs 330 to the desk assembly 310. For example, the joining pivot plates 440 may be connected between the upper edge of respective ones of the pair of side rails 312 of the desk assembly 310 and the first end of respective ones of the pair of connecting legs 330 such that the first end of respective ones of the pair of connecting legs 330 is rotatably attached to the upper edge of respective ones of the pair of side rails 312 of the desk assembly 310.

The length of the connecting legs 330 may determine the distance between the desk assembly 310 and the bed assembly 320 when the convertible furniture object 100 is in the second position (or, alternatively, the bed position), and the length of the hook arm 420 may be designed based on the length of the connecting legs 330.

Referring to FIG. 10, the design of the connecting between the frame 200 and the convertible assembly 300 may form a parallelogram P that allows the desktop 316*a* to maintain a level position as the convertible furniture object 100 transitions between the first position and the second position. The parallelogram P may include a first side formed by the main plate 410 from a first end of the hook arm 420 to the pivot bushing 415, a second side formed from by an imaginary line extending from the pivot bushing 415 to the pivot point on the joining pivot plate 440 attached between the upper edge of respective ones of the pair of side rails 312 of the desk assembly 310 and the first end of respective ones of the pair of connecting legs 330, a third side formed by a portion of the side rails 312 of the desk assembly 310 extending between the pivot point of the joining pivot plate 440 and the bearing post 425, and a forth side formed by the hook arm 420 resting on the bearing post.

In some example embodiments, the distance between the desk assembly 310 and the bed assembly 320 when the convertible furniture object 100 is in the second position (or, alternatively, the bed position) may be between 12 inches and 24 inches, for example approximately 15-16 inches. However, example embodiments are not limited thereto. As the distance between the distance between the desk assembly 310 and the bed assembly 320 when the convertible furniture object 100 is in the second position (or, alternatively, the bed position), the height of the bed platform 326*a* may increase, which if too tall may be inconvenient for user access. In some example embodiments, the height of the bed platform 326*a* may be between 18 inches and 36 inches, such as, for example, approximately 24 inches. However, example embodiments are not limited thereto. The length and width of the bed platform may vary based on the size of the mattress (e.g., twin, twin xl, full, queen, king, or California king) configured to rest on the bed platform 326*a*.

In contrast, the height of the desktop 316*a* when the convertible furniture object 100 is in the first position (or, alternatively, the desk position) may be greater than the height of the height of the bed platform 326*a* when the convertible furniture object 100 is in the second position (or, alternatively, the bed position. For example, in some example embodiments, the height of the height of the desktop 316*a* when the convertible furniture object 100 is in the first position (or, alternatively, the desk position) may be between 24 and 48 inches, such as, for example, approximately 30 inches. The height of desktop 316*a* when the convertible furniture object 100 is in the first position (or, alternatively, the desk position) may be designed to accommodate a user sitting on a chair, sitting on a stool, or standing, for example. However, example embodiments are not limited thereto.

While the figures illustrate a rectangular shaped desktop 316*a*, example embodiments are not limited thereto. For example, as the size of the bed platform 326*a* increases, the convertible furniture object 100 may be able to accommodate a desktop 316*a* that is larger without further increasing the size of the convertible furniture object 100. Therefore, in other example embodiments, the desktop 316*a* may, for example, include a cutout therein that allows the desktop 316*a* to be u-shaped.

Further, in some example embodiments, the desktop 316*a* may further include one or more drawers (e.g., a keyboard shelf) extending from a bottom surface of the base 316.

Figure 11:
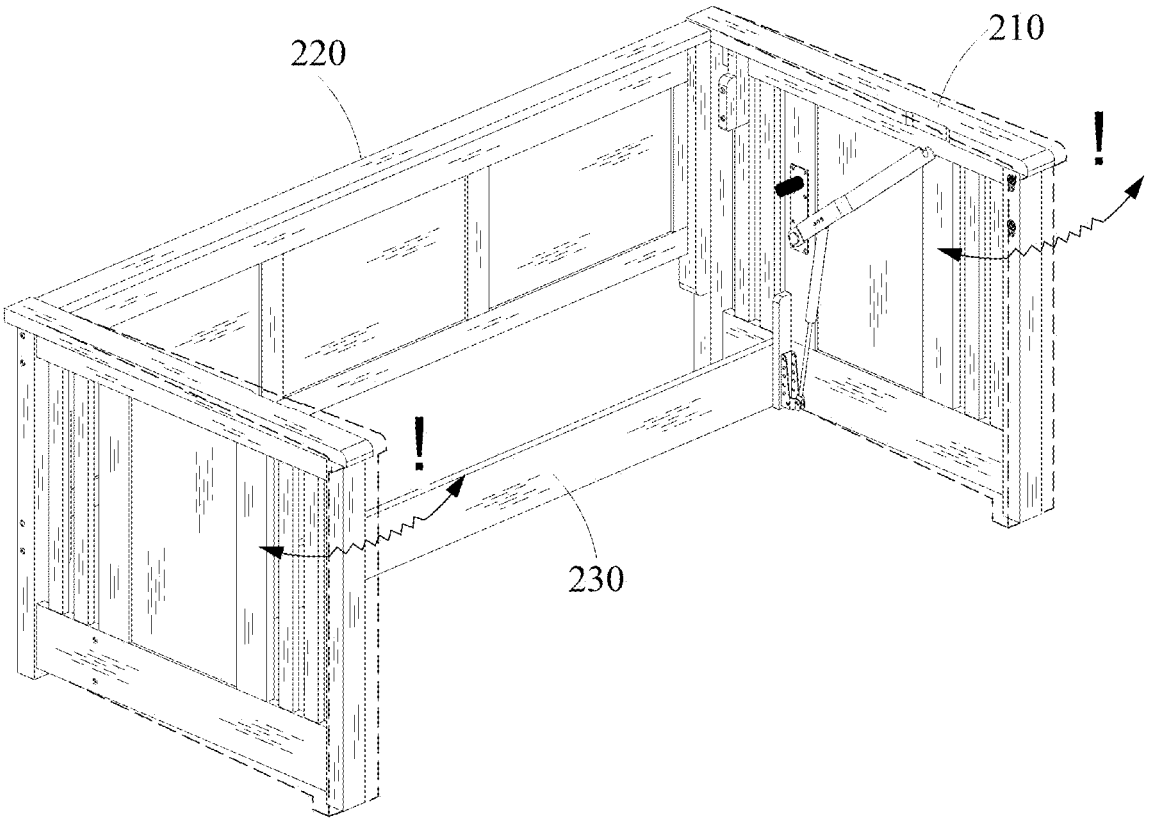
FIGS. 11 to 13 illustrate instability addressed by a convertible furniture object according to some example embodiments.
Figure 12:
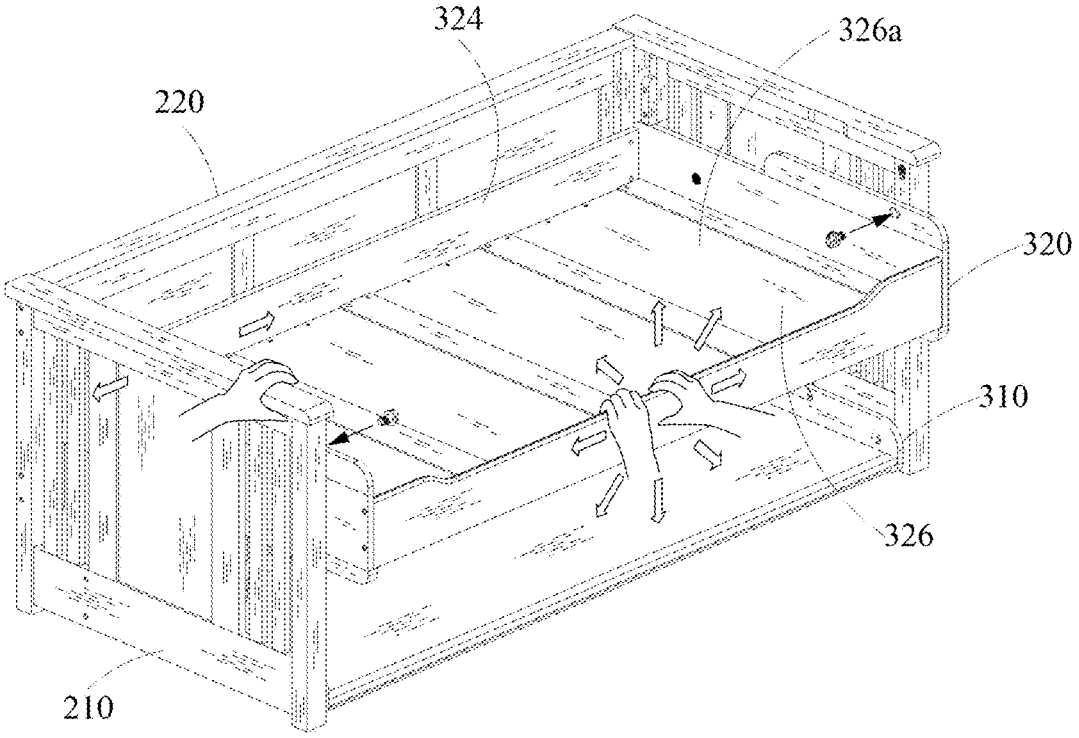
Figure 13:
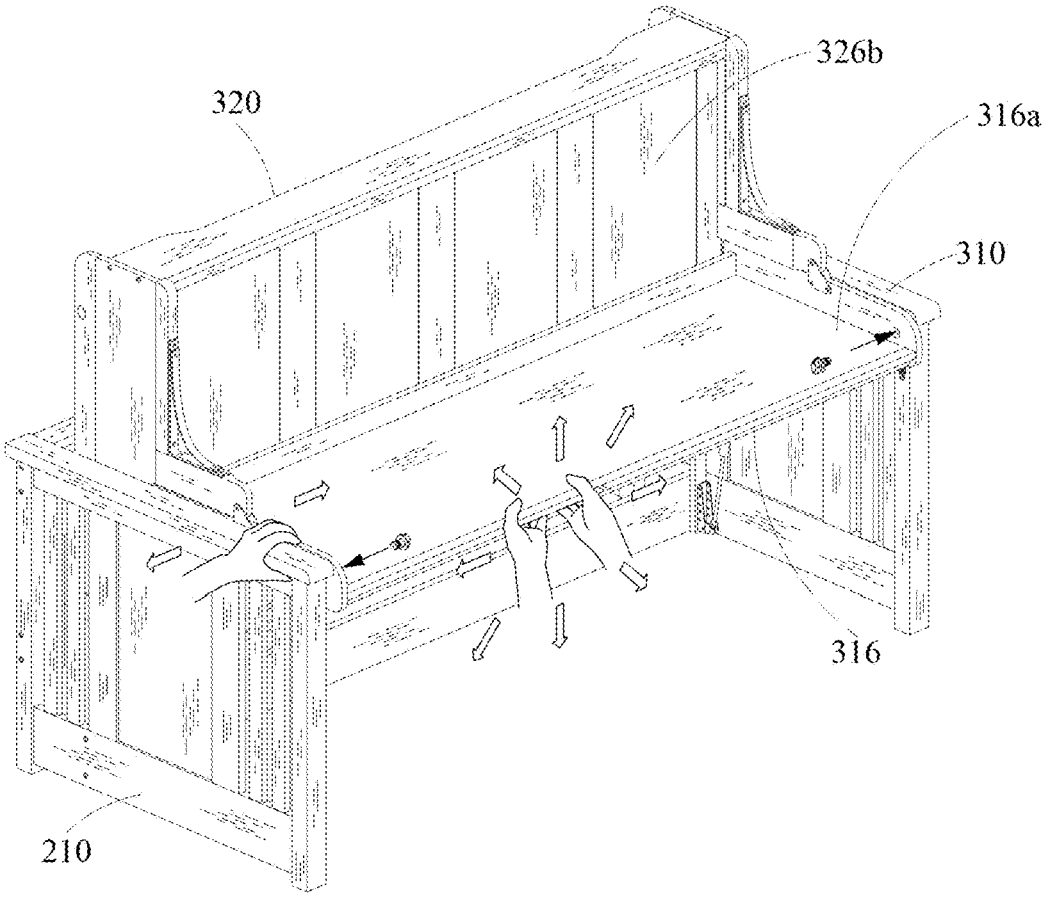

FIGS. 11 to 13 illustrate instability addressed by a convertible furniture object according to some example embodiments.

Referring to FIGS. 11 to 13, the convertible furniture object 100 may have some instability and may, for example, shake or wobble.

For example, as shown in FIG. 11, while the stretcher rail 230 may provide some stability for the frame 200, the end of the side panels 210 of the frame 200 that are not attached to the back panel 220 may still have some instability and may be movable side-to-side. Further, the instability in the frame 200 may be exacerbated in embodiments where the side panels 210 are hangable attached to the back panel 220 to reduce the size of the kit.

Further, as illustrated in FIGS. 12 and 13, the convertible assembly 300 may have some instability and may be movable in various directions relative to the frame 200. For example, as discussed above, the pivot bushing 415 attached to the frame 200 is freely movable within the pivot hole 323 and thus, in addition to allowing the convertible assembly 300 to pivot about the pivot bushing 415, the convertible assembly 300 maybe movable in various directions relative to the frame 200.

The movement of the side panels 210 of the frame 200 and the movement of the movement of the convertible assembly 300 relative to the frame 200 may be undesirable and may render the convertible furniture object 100 to feel unstable, poorly designed, and may make the use of the desk and/or bed inconvenient.

Figure 14:
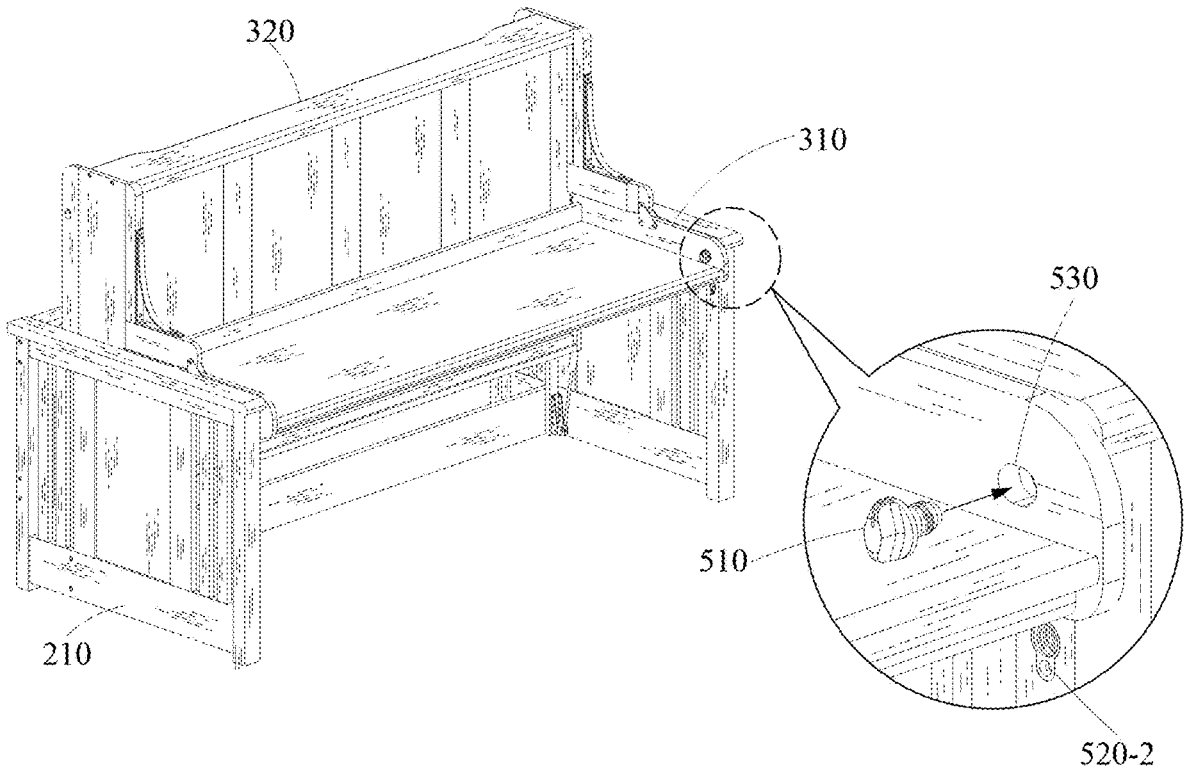
FIGS. 14 and 15 illustrate a solution to address instability of a convertible furniture object in a first position and a second position, respectively, according to some example embodiments.

FIGS. 14 and 15 illustrate a solution to address instability of a convertible furniture object in a first position and a second position, respectively, according to some example embodiments.

Referring to FIGS. 14 and 15, the convertible furniture object 100 may include a binding assembly 500 configured to cinch the convertible assembly 300 to the frame 200.

The binding assembly 500 may include first portion 510 and a second portion 520.

The first portion 510 may be configured to cinch the convertible assembly 300 to the frame 200 in the desk position or the bed position by traversing slotted holes 530 in either the pair of side rails 312 of the desk assembly 310 or in the pair of side rails 322 of the bed assembly 320 and mating with the second portion 520 in respective ones of the side panels 210.

Figure 16:
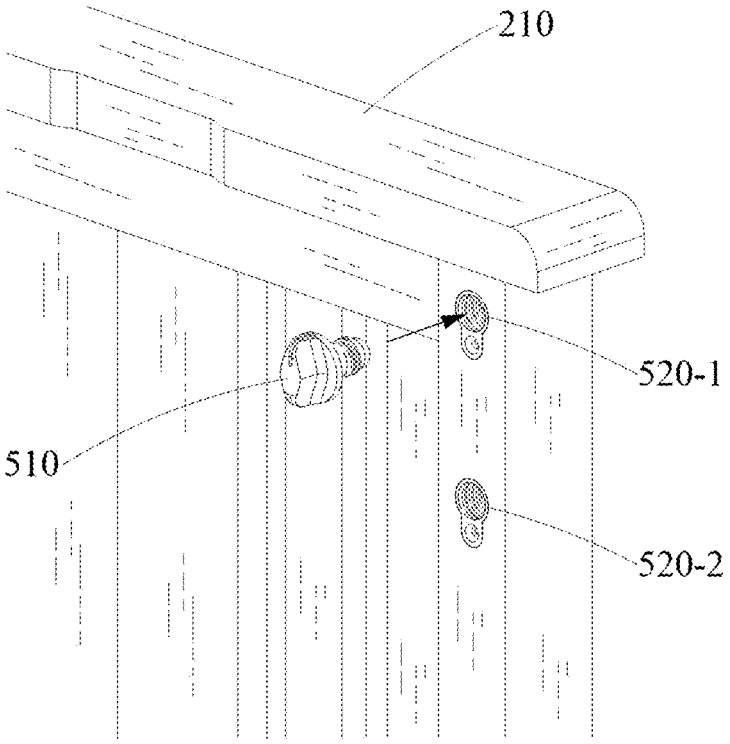
FIGS. 16 to 18 illustrate details of a solution to address instability of a convertible furniture object according to some example embodiments.
Figure 17:
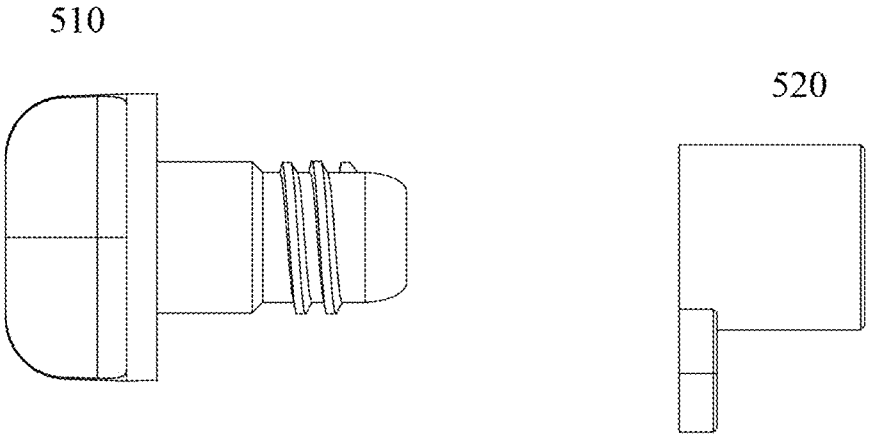
Figure 18:
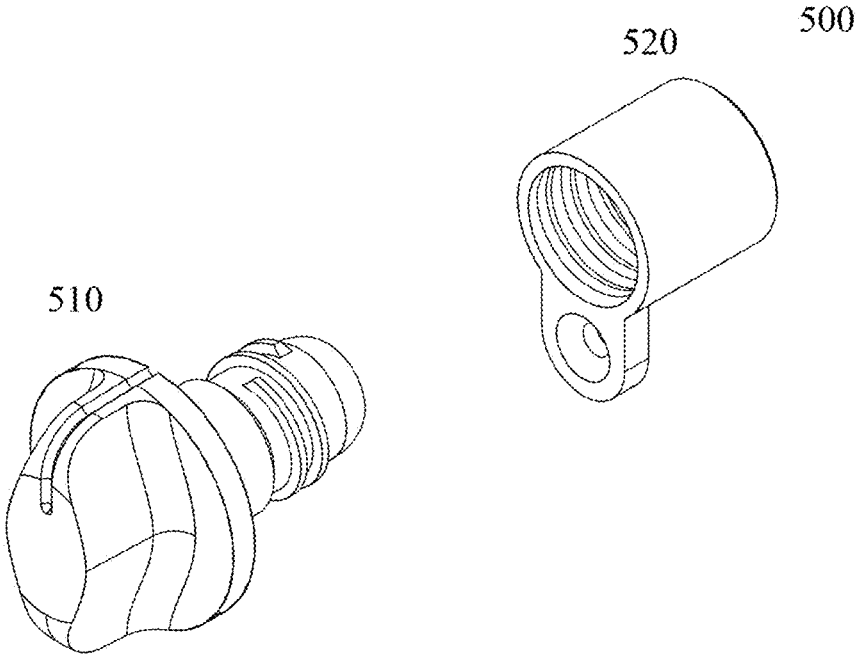

FIGS. 16 to 18 illustrate details of a solution to address instability of a convertible furniture object according to some example embodiments.

Referring to FIGS. 16 to 18, the first portion 510 may be a male fastener, such as, a bolt or knob, and the second portion 520 may be a female embedded threated insert, such as a socket, formed in each of the side panels 210. However, example embodiments are not limited thereto.

In some example embodiments, the first portion 510 and the second portion 520 may each be threaded and have threads that correspond to each other. For example, the binding assembly 500 may include a conventional bolt and metal threaded insert. The second portion 520 may be formed by having borehole with a machined notch extending therefrom in the side panels 210 and filling the borehole with the machined notch with a female socket. The first portion 510 and the second portion 520 may each be made of plastic or metal. However, example embodiments are not limited thereto. For example, in other example embodiments, a first one of the side panels 210 or the convertible assembly 300 may include a spring-loaded plunger therein that when extended locks into a corresponding hole in a second one of the side panels 210 or the convertible assembly 300. As such, a user convenience may be improved since the first portion 510 is not removable and thus is not susceptible to becoming lost.

While example embodiments are described above in which the binding assembly 500 includes a female embedded threaded insert, example embodiments are not limited thereto and the binding assembly 500 may be embodied as any device that selectively cinches the convertible assembly 300 to the frame 200. For example, a through hole may be formed through the side of the side panels 210 and the first portion 510 of the binding assembly 500 may traverse both the slotted holes 530 in the side rails 312, 322 and the through hole the side panels 210 and mate with a nut, such as a wing nut attached to an outer side of the side panels 210.

In some example embodiments, the second portion 520 may be a pair of female sockets aligned with each other at different heights on each of the side panels 210. For example, the second portion may include a first socket 520-1 associated with cinching the convertible assembly 300 to the frame 200 in the desk position and a second socket 520-2 associated with cinching the convertible assembly 300 to the frame 200 in the bed position. As discussed above, since the height of the desktop **316*a* when the convertible furniture object 100 is in the first position (or, alternatively, the desk position) may be greater than the height of the height of the bed platform 326*a* when the convertible furniture object 100 is in the second position (or, alternatively, the bed position), the first socket 520-1 may be relatively higher than the second socket 520-2** such that the desk position is higher than the bed position. However, example embodiments are not limited thereto.

In other example embodiments, each of the side panels 210 may include only a single second portion 520 that aligns with both the slotted holes 530 in the pair of side rails 312 of the desk assembly 310 and the slotted holes 530 in the pair of side rails 322 of the bed assembly 320. For example, since the desk position may be higher than the bed position, the slotted holes 530 in the pair of side rails 312 of the desk assembly 310 may be arranged below the desktop **316*a* rather than above the desktop 316*a* while the slotted holes 530 in the pair of side rails 312 of the desk assembly 310 may remain above the bed platform 326*a*. As such, both sets of the slotted holes 530 may align with the single second portion 520 when the when the convertible furniture object 100** is in the first position (or, alternatively, the desk position) and the second position (or, alternatively, the bed position).

Figure 19:
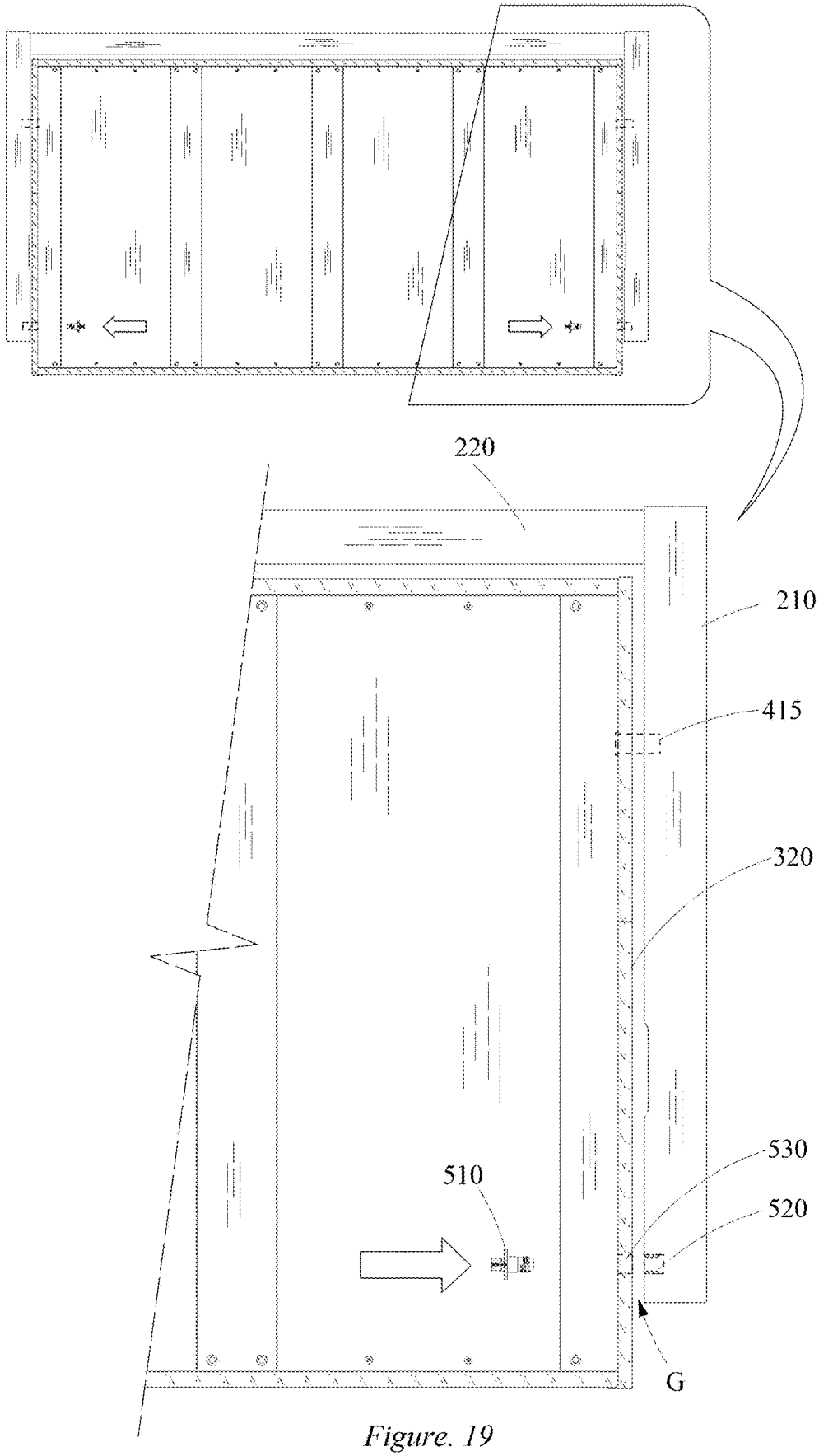
FIGS. 19 and 20 illustrate the benefit of the solution to address instability of a convertible furniture object according to some example embodiments.
Figure 20:
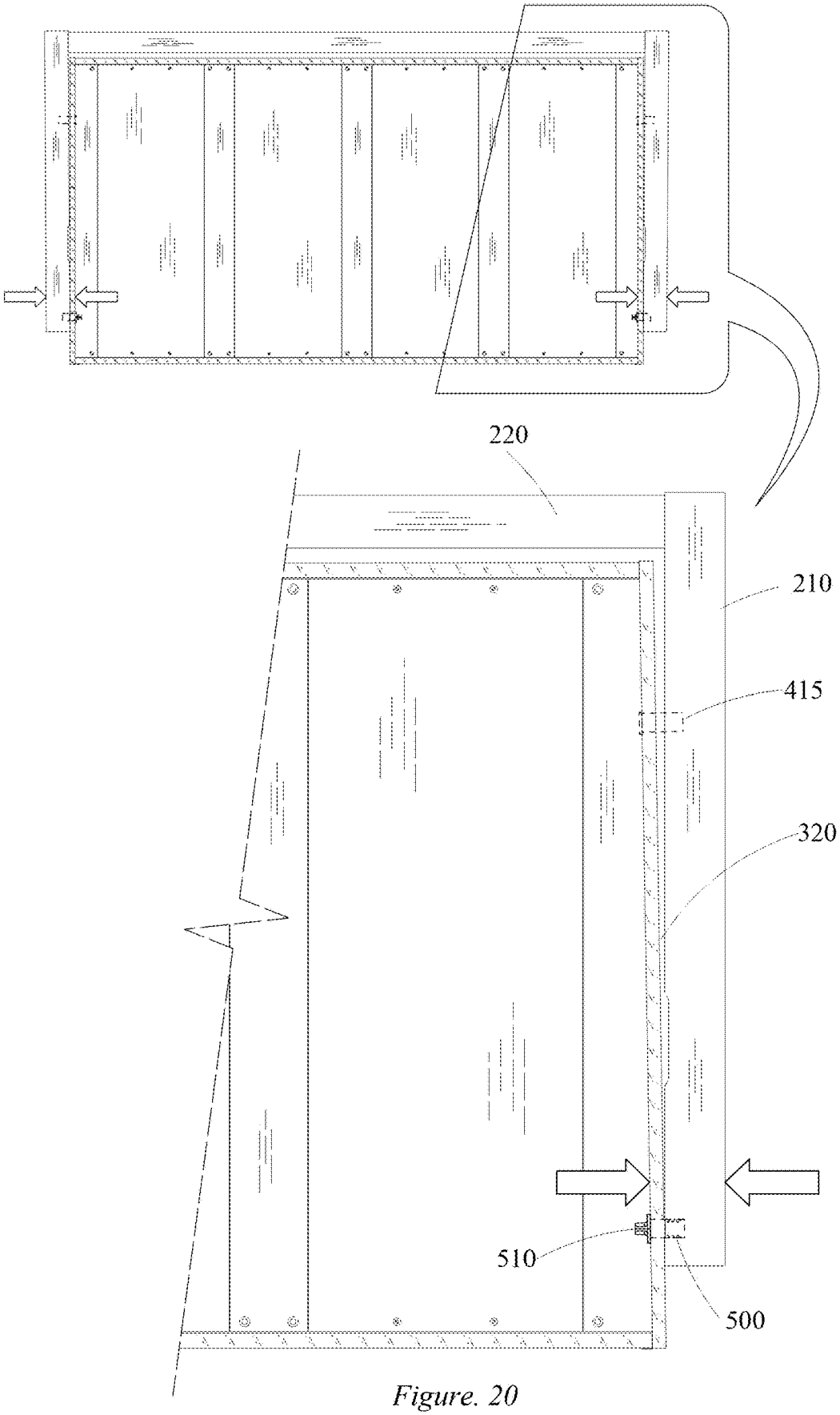

FIGS. 19 and 20 illustrate the benefit of the solution to address instability of a convertible furniture object according to some example embodiments.

Referring to FIGS. 19 and 20, as illustrated in FIG. 19, prior to cinching the convertible assembly 300 to the frame 200, a gap G may exist between each of pair of the side rails 312 of the desk assembly 310 or in the pair of side rails 322 of the bed assembly 320. As discussed above, the convertible assembly 300 and the frame 200 are connected in the rear portion via the pivot bushing 415 that is freely movable in all directions within the pivot hole 323, and, thus, the side panels 210 of the frame 200 and the convertible assembly 300 may be unstable.

However, as illustrated in FIG. 20, after the first portion 510 of the binding assembly 500 mates with the second portion 520 of the binding assembly 500 in respective ones of the side panels 210 while traversing through the slotted holes 530 in either the pair of side rails 312 of the desk assembly 310 or in the pair of side rails 322 of the bed assembly 320, the gap G may be reduced (or, alternatively, eliminated) as the convertible assembly 300 and the frame 200 are cinched together. Once cinched, the convertible assembly 300 and the frame 200 are connected in the rear portion of the convertible furniture object 100 via the pivot bushing 415 and cinched in the front portion of the convertible furniture object 100 via the binding assembly 500. Therefore, the stability of the desktop **316*a* and the bed platform 326*a* may be improved without additional structural elements, such as a hutch and/or side wings extending from the side panels 210, which may be visually undesirable and add weight and cost to the design of the convertible furniture object 100**.

Further, the convertible furniture object 100 may pivot between the first position (or, alternatively, the desk position) and the second position (or, alternatively, the bed position) while the desktop **316*a*** remains level without the use of a complex mechanism that includes, for example, chains, pinions, shafts, racks, a motor and/or wheels.

The description of the disclosure is merely an example and, thus, variations that do not depart from the gist of the disclosure are intended to be within the scope of the disclosure. Such variations are not to be regarded as a departure from the spirit and scope of the disclosure.

What is claimed is:

1. A convertible furniture apparatus, comprising:

a frame;

a convertible assembly connected to the frame via at least a pair of pivot points each connected to respective side panels of the frame, the convertible assembly configured to transition between a first position and a second position by pivoting about the pivot points; and a binding assembly configured to selectively cinch the convertible assembly to the frame when the convertible assembly is in the first position or the second position by applying a tensile force to draw the frame toward the convertible assembly under mechanical tension such that an amount of the tensile force applied varies based on a degree of engagement of the binding assembly.

2. The convertible furniture apparatus of claim 1, wherein the convertible assembly comprises:

a pair of assemblies; and connecting legs pivotally connecting the pair of assemblies.

3. The convertible furniture apparatus of claim 2, wherein the pair of assemblies comprises:

a first assembly including a pair of first side rails, a first long rail extending perpendicular to the pair of first side rails and a first base attached to the pair of first side rails and the first long rail; and a second assembly including a pair of second side rails, a pair of second long rails extending perpendicular to the pair of second side rails and a second base attached to the pair of second side rails and the pair of second long rails, wherein the connecting legs are fixedly attached to a bottom surface of respective ones of the pair of second side rails and rotatably attached to a top surface of respective ones of the pair of first side rails.

4. The convertible furniture apparatus of claim 3, wherein the first assembly is a desk assembly and the second assembly is a bed assembly with an upper surface of the first base configured as a desktop of the desk assembly and a lower surface of the first base configured as a backboard of the desk assembly when the convertible furniture apparatus is in the first position, and an upper surface of the second base configured as a bed platform of the bed assembly when the convertible furniture apparatus is in the second position.

5. The convertible furniture apparatus of claim 4, wherein, during the transition between the first position and the second position, the desktop remains level while the bed platform pivots 90 degrees.

6. The convertible furniture apparatus of claim 5, wherein the bed platform is perpendicular to the desktop when the convertible furniture apparatus is in the first position such that the bed platform is stowed vertically, and the bed platform is to parallel to the desktop when the convertible furniture apparatus is in the second position.

7. The convertible furniture apparatus of claim 5, further comprising:

a mechanical assembly including a plate secured to a respective one of the side panels, the plate having a pivot bushing extending therefrom defining a respective one of the pivot points, a hook arm having a first end rotatably connected to the plate and a second end rotatably connected a respective one of the pair of first side rails, and a gas lift configured to transmit a force to the hook arm to counterbalance a weight of the convertible assembly.

8. The convertible furniture apparatus of claim 7, wherein connections between the frame and the convertible assembly form a parallelogram with a shape that adjusts to allow the desktop to remain level during the transition between the first position and the second position.

9. The convertible furniture apparatus of claim 7, wherein an amount of the force transmitted by the gas lift is adjustable based on the weight of the convertible assembly.

10. The convertible furniture apparatus of claim 3, wherein the binding assembly is configured to traverse first through holes in the pair of first side rails to cinch the first assembly to the frame when the convertible furniture apparatus is in the first position, and to traverse second through holes in the pair of second side rails to cinch the second assembly to the frame when the convertible furniture apparatus is in the second position.

11. The convertible furniture apparatus of claim 10, wherein the binding assembly includes a first portion and a second portion, the first portion configured to selectively mate with the second portion by traversing at least the first through holes or the second through holes depending on a position of the convertible furniture apparatus.

12. The convertible furniture apparatus of claim 11, wherein the second portion is fixedly attached to respective ones of the side panels of the frame.

13. The convertible furniture apparatus of claim 12, wherein the second portion includes two sockets attached fixedly attached at different heights to each of the side panels of the frame.

14. The convertible furniture apparatus of claim 13, wherein the two sockets comprise:

a first socket configured to selectively mate with the second portion to cinch the first assembly to the frame when the convertible furniture apparatus is in the first position, the first socket being fixedly attached a first height to each of the side panels of the frame; and a second socket configured to selectively mate with the second portion to cinch the second assembly to the frame when the convertible furniture apparatus is in the second position, the second socket being fixedly attached a second height to each of the side panels of the frame, the second height being less than the first height.

15. The convertible furniture apparatus of claim 11, wherein the side panels of the frame include fixed through holes therein extending from a first side the side panels that face the convertible assembly to a second side opposite the first side, and the first portion of the binding assembly is configured to selectively mate with the second portion of the binding assembly by, after traversing the at least the first through holes or the second through holes, further traversing through the fixed through holes in the side panels of the frame from the first side of the side panels to mate with the second portion of the binding assembly from the second side of the side panels.

16. The convertible furniture apparatus of claim 1, wherein when the binding assembly cinches the convertible assembly to each of the side panels of the frame, the convertible assembly is connected to each of the side panels of the frame at respective ones of the pivot points at which the convertible assembly is free to move relative to the frame and at cinch points at which the convertible assembly is restricted from moving relative to the frame.

17. The convertible furniture apparatus of claim 16, wherein the cinch points are further from a back panel of the frame than respective ones of the pivot points.

18. The convertible furniture apparatus of claim 16, wherein, at the cinch points, a gap between the convertible assembly and the side panels of the frame decreases when the binding assembly cinches the convertible assembly to the side panels of the frame.

19. A convertible furniture apparatus, comprising:

a frame;

a convertible assembly connected to the frame via at least a pair of pivot points each connected to respective side panels of the frame, the convertible assembly configured to transition between a first position and a second position by pivoting about the pivot points, the convertible assembly including a first assembly and a second assembly, the first assembly including a pair of first side rails, and the second assembly including a pair of second side rails; and a binding assembly configured to selectively cinch the convertible assembly to the frame by, traversing first through holes in the pair of first side rails to cinch the first assembly to the frame when the convertible furniture apparatus is in the first position, and traversing second through holes in the pair of second side rails of the frame to cinch the second assembly to the frame when the convertible furniture apparatus is in the second position.

* * * * *